United States Patent [19]

Boire et al.

[11] Patent Number: 4,612,520

[45] Date of Patent: Sep. 16, 1986

[54] WIDEBAND 180-DEGREE PHASE SHIFTER BIT

[75] Inventors: Daniel C. Boire, Ferndale; James E. Degenford, Ellicott City; Marvin Cohn, Baltimore, all of Md.

[73] Assignee: Westinghouse Electric Corp., Pittsburgh, Pa.

[21] Appl. No.: 740,355

[22] Filed: Jun. 3, 1985

[51] Int. Cl.[4] ..... H01P 1/18

[52] U.S. Cl. ..... 333/156; 333/161; 333/164

[58] Field of Search ..... 333/138–140, 333/156–161, 164, 238, 246, 23

[56] References Cited

U.S. PATENT DOCUMENTS 3,781,722 12/1973 Pierson ..... 333/156

4,471,330 9/1984 Naster et al. ..... 333/164

*Primary Examiner*—Marvin L. Nussbaum

*Attorney, Agent, or Firm*—W. G. Sutcliff

[57] ABSTRACT

A wideband 180-degree digital phase shifter bit is provided which is operable independently of input rf frequency over a predetermined bandwidth of interest. The phase shifter bit comprises a coupled transmission line segment and a pi network segment, with switching means for alternatively connecting the rf input and rf output first to the coupled transmission line segments, and then to the pi network.

4 Claims, 6 Drawing Figures

WIDEBAND 180-DEGREE PHASE SHIFTER BIT

BACKGROUND OF THE INVENTION

The present invention relates to a wideband phase shifter, and, more particularly, a 180-degree digital bit in which the 180-degree phase shift is obtained independent of the electrical length of the transmission line sections which make up the phase shifter.

Phase shifters are devices in which a difference in the phase of an electromagnetic wave of a give frequency propagating through a transmission line can be shifted. Such phase shifters are utilized in many microwave systems and in particular are required for electronic beam steering in phased array radar systems. A typical prior art wide-band 180-degree phase shifter bit is constructed by placing switching diodes at the coupled and through ports of a branch line or Lange coupler. By switching the diodes off and on, the signal appearing at the output ports of the coupler exhibit a relative 180-degree phase shift. Such a phase shifter is limited to generally less than an octave bandwidth at microwave frequency because of phase shift deviations from the desired 180 degrees.

Other types of phase shifters are found in the prior art in which a change in phase is obtained by utilizing one of a number of lengths of transmission line to approximate the desired value of phase change. The various lengths of transmission line are inserted and removed by high speed electronic switching. Semiconductor diodes and ferrites are the devices commonly employed in digital phase shifters. One such digitally switched phase shifter is a parallel-line configuration in which the proper transmission line length is selected from among many available parallel lines. An alternative phase shifter is a seriesline or a cascaded multi-bit digitally switched phase shifter. Such phase shifters are described more generally in "Introduction to Radar Systems", 2nd Edition, by M. L. Skolnick, 1982, pg. 286.

Such prior art phase shifters have in general not been found to be usable over a wide bandwidth due to high insertion losses and a non-linear phase shift versus frequency characteristic throughout the band of interest.

It is desirable to provide a 180-degree phase shifter bit which is operable with a linear response over the range of 4.5 to 18 GHz. It is also desirable that the phase shifter be as small as possible and compatible with monolithic microwave integrated circuit manufacturing techniques.

SUMMARY OF THE INVENTION

A wideband 180-degree phase shifter bit is provided which is operable independently of input rf frequency over a predetermined bandwidth of interest to produce a 180-degree phase shifted rf output. The phase shifter bit comprises a coupled transmission line segment with opposed ends of each line being connectable respectively to rf input and rf output, with the other end of each line being grounded. The phase shifter bit further comprises a pi network transmission line segment having a central line portion having opposed ends from which extend grounded line portions, and which opposed ends are respectively connectable to the rf input and rf output of the device, and wherein switching means for alternatively connecting the rf input and rf output first to the coupled transmission line segments, and then to the pi network.

This 180-degree phase shifter bit is operative over the range of 4.5 to 18 GHz with a linear phase shift which is independent of frequency. The 180-degree phase shift is obtained independent of the electrical length of the phase shifter bit transmission line segments. This enables the phase shifter bit to be of small size permitting its fabrication on a monolithic microwave substrate.

DESCRIPTION OF THE PREFERRED EMBODIMENTS

Figure 1:
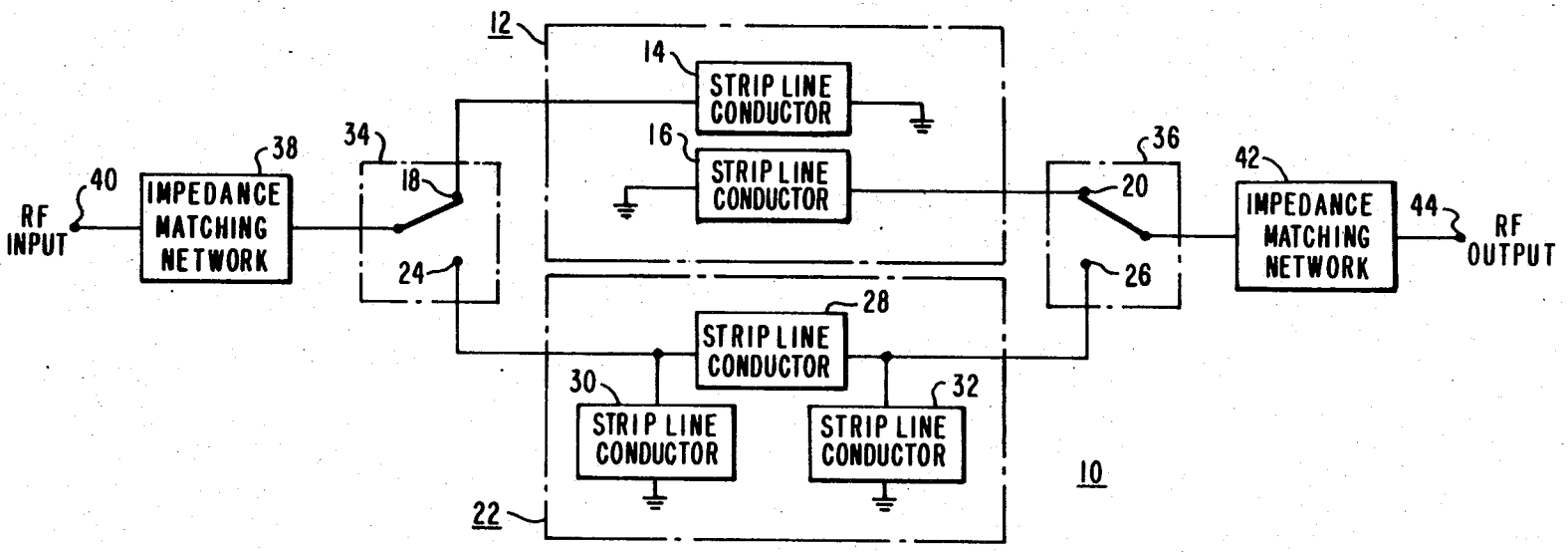
FIG. 1 is a schematic representation of the wideband 180-degree shifter bit of the present invention.

The wide bandwidth 180-degree phase shifter bit of the present invention is illustrated in schematic fashion in FIG. 1. The phase shifter bit 10 comprises a first transmission line portion 12 of coupled transmission line segments 14 and 16 of equal electrical length, and with opposed ends of each transmission line terminating in terminals 18 and 20 with the other end of each transmission line being grounded. A second transmission line portion 22 is connected to terminals 24 and 26 and comprises a pi network having a central line portion 28 having opposed ends from which extend grounded line portions 30 and 32 with the extending ends of the central line portion connected to terminals 24 and 26. The transmission line portions 28, 30, and 32 are all of equal electrical length, and are also equal to the electrical length of the coupled line segments 14 and 16. A first switching means 34 is switchable between terminals 18 and 24, and a second switching means 36 is switchable between terminals 20 and 26. The first switching means 34 is connected via impedance matching network 38 to rf input terminal 40. The second switching means 36 is connected via impedance matching network 42 to rf output terminal 44. The first switching means 34 and second switching means 36 are operated together to switch respectively the rf input and rf output between the coupled line transmission portion 12 and the pi network transmission portion 22.

It can be shown that electrically the coupled line transmission portion 12 and the pi network transmission portion 22 comprise two networks which are exactly equivalent for all frequencies with the exception that the transmission phase difference between the coupled line portion and the pi network portion is exactly 180 degrees. The pi network is equivalent to the shorted coupled line portion preceded by an ideal phase-reversing transformer. This result is independent of the electrical length of the transmission lines of the two networks and thus independent of frequency. The switching means alternatively connect the rf input and rf output to the coupled shorted transmission line segments and thereafter to the pi network, with these two networks behaving identically as band-pass filters. The 180-degree phase shift obtained by switching between the shorted coupled line portion and the pi network portion of the phase shifter is obtained independent of the electrical length of the transmission line sections which make up the device. In this way, the transmission line sections can be of short length, i.e., substantially less than a quarter wavelength at the band center. The impedance matching means permits tuning of the transmission portions. The switching means 34 and 36 can be field effect transistor switches or semiconductor diode switches.

Figure 2:
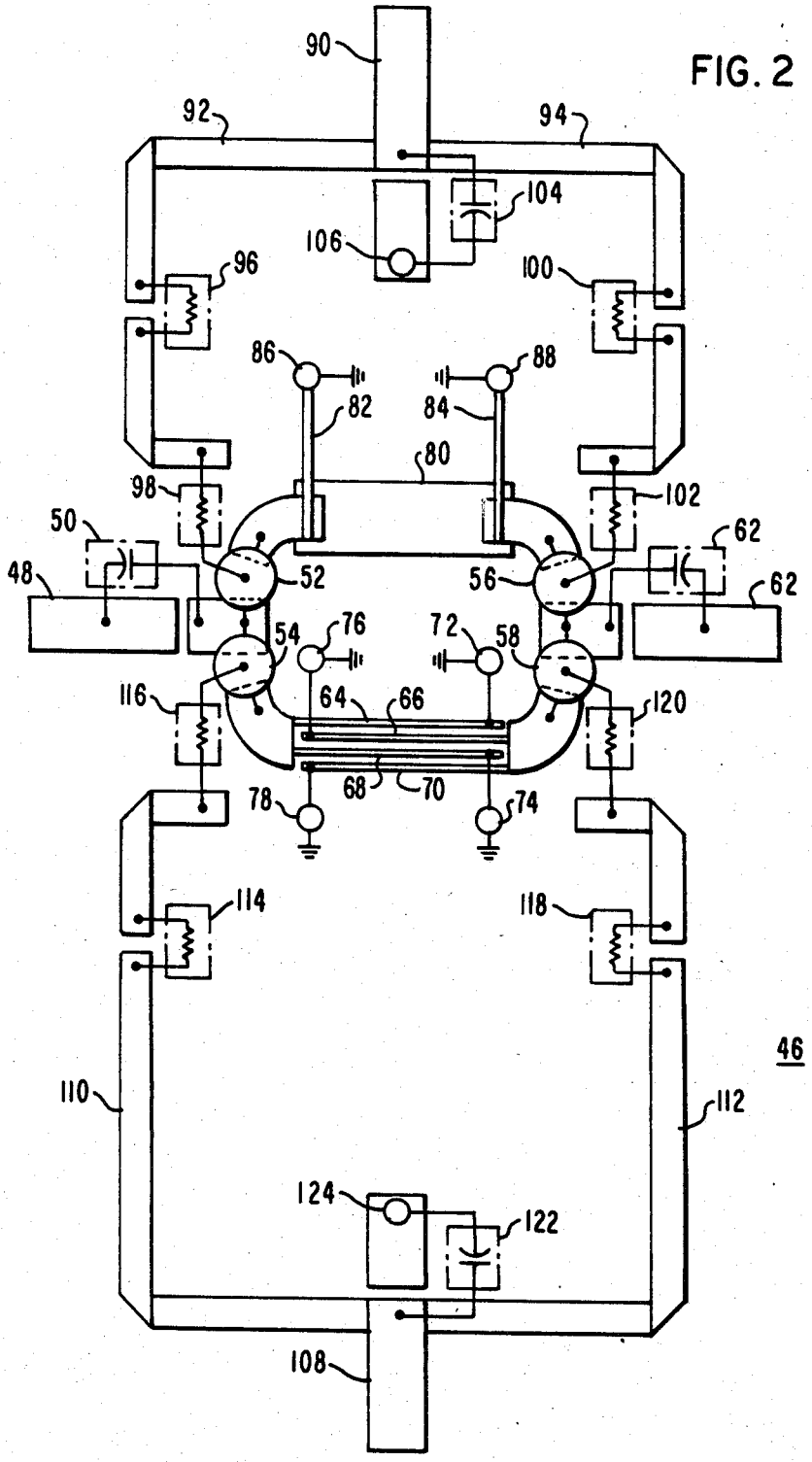
FIG. 2 is a plan view illustration of the 180-degree phase shifter bit of the present invention embodied in a hybrid monolithic microwave circuit.

The wideband 180-degree phase shifter bit of the present invention has been implemented as a monolithic microwave integrated circuit seen in FIG. 2, using an alumina substrate which is 0.025" thick and ½"×1" dimension. The alumina substrate 46 has deposited thereon strip line conductive material which makes up the transmission line portions of 180-degree digital phase shifter bit with hybrid circuit components mounted upon the alumina substrate to complete the circuit. Strip line conductor segment 48 comprises the rf input terminal and a hybrid impedance matching capacitor 50 is serially connected in this rf input strip line with a pair of field effect transistors having their drains connected to the impedance matching capacitor. The pair of FET transistors 52 and 54 comprise the input switching means 34 referred to in FIG. 1. The respective source terminals of FET transistors 52 and 54 are connected to the shorted coupled transmission line portion 12 and to the pi transmission network 22. Another pair of FET transistors 56 and 58 have their source terminals connected to the opposed ends of the coupled line transmission segment 12 and pi network 22, with the drains of transistors 56 and 58 connected to output impedance matching capacitor 60, which is in turn serially connected to rf output terminal strip line 62. The coupled transmission line portion 12 in this embodiment actually comprises four interdigitated fingers of strip line 64, 66, 68, and 70. One end of interdigitated fingers 64 and 68 are connected to the source of switching transistor 54 with the opposed ends of these fingers 64 and 68 being grounded at ground terminals 72 and 74 which extend through the alimina substrate and are connected to a ground plane disposed on the opposed side of the alumina substrate 46. Wire bond connectors extend between the ground terminals 72 and 74 and the ends of strip line interdigitated fingers 64 and 68. The other two interdigitated fingers 66 and 70 have one end connected to the source terminal of switching transistor 58 and the opposed ends of the strip line fingers 66 and 70 are connected by wire bonds to ground terminals 76 and 78 which are also connected through the alumina substrate 46 to a ground plane conductor on the back surface of the alumina substrate.

The pi network 22 is comprised of strip line conductor 80, the opposed ends of which are connected to the sources of respective FET transistors 52 and 56. The grounded stub lines 82 and 84 extend also from the opposed ends of the strip line 80, which stub lines 82 and 84 are grounded at their opposed ends to ground terminals 86 and 88 respectively.

The upper portion of the illustration of FIG. 2 comprises a bias input network for applying a biasing potential to the gates of switching transistors 52 and 56. Strip line bias input portion 90 feeds the branched strip line portions 92 and 94 with strip line branch 92 having a 2 kilo-ohm resistor 96 disposed in the line and a 3 kilo-ohm resistor 98 which is connected to the gate of FET transistor. The other branch of the strip line 94 likewise has a 2 kilo-ohm resistor 100 and a 3 kilo-ohm resistor 102 in this line connected to the gate of FET transistor 56. The bias input feed line 90 is also terminted via capacitor 104 which is connected to ground post terminal 106.

The bias network for the coupled line transmission portion is shown in the lower half of FIG. 2 and comprises strip line bias input portion 108 which is connected to branched strip line portions 110 and 112. Strip line conductor 110 has a 2 kilo-ohm resistor 114 and a 3 kilo-ohm resistor 116 serially connected in the line and connected to the drain of FET transistor 54. Strip line branch line 112 likewise has a 2 kilo-ohm resistor 118 and a 3 kil-ohm resistor 120 serially connected to the gate of FET transistor 58. Bias strip line input 108 is also terminated by means of capacitor 122 which is connected, in turn, to ground post 124. The bias strip line inputs 90 and 108 are connected to appropriate biasing potential for switching the FET transistors so that the rf input signal is alternatively switched between the coupled transmission line portion 12 and thereafter switched to the high transmission network 22 to carry out the 180-degree phase shifting function.

Figure 3:
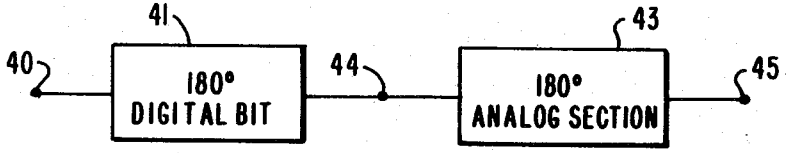
FIG. 3 is a schematic illustration of a wide bandwidth phase shifter in which the 180-degree digital bit phase shifter is serially connected to a 180-degree analog phase shifter section.

The 180-degree digital phase shifter bit of the present invention is seen serially connected in FIG. 3 to a 180-degree analog phase shifter section illustrated in block schematic form to illustrate how a wide bandwidth phase shifter comprising a digital bit and an analog section can be provided.

Figure 4:
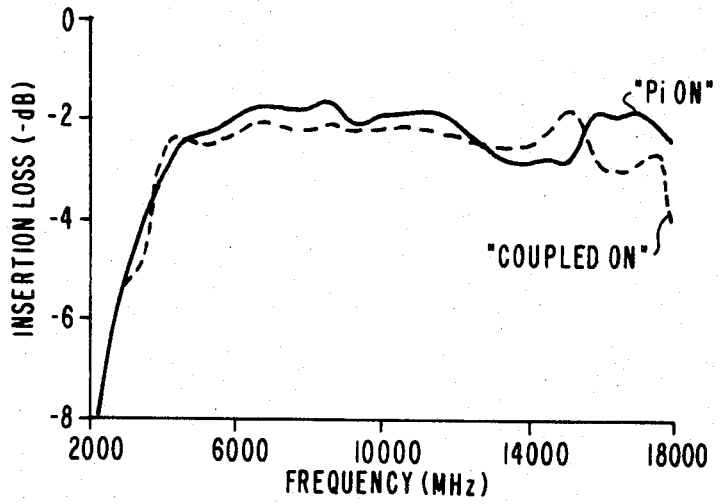
FIG. 4 is a plot of the phase bit insertion loss plotted against frequency of operation for the phase shifter of the present invention.
Figure 5:
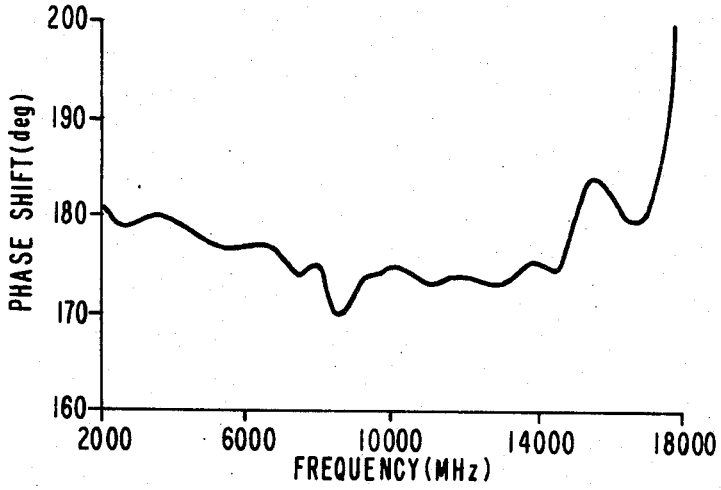
FIG. 5 is a plot of the phase bit phase performance illustrating phase shift relative to 180 degrees over the operating frequency.
Figure 6:
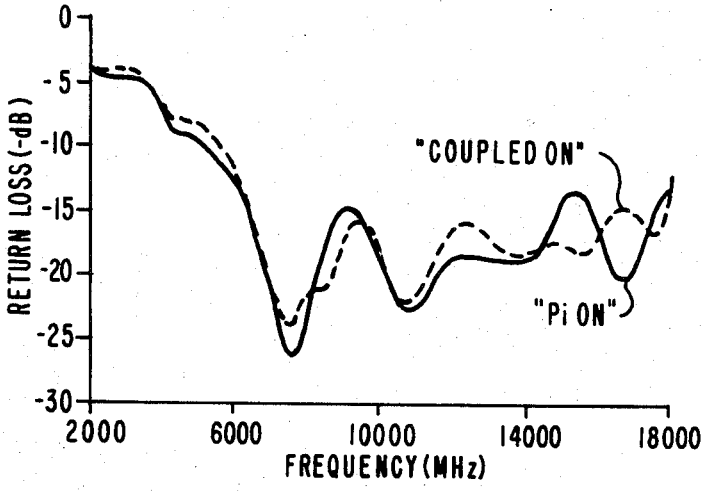
FIG. 6 is a plot of the phase bit return loss plotted against frequency for the phase shifter bit of the present invention.

FIG. 4 illustrates the phase bit insertion loss measured in minus decibels plotted against frequency over the range from about 4 to 18 GHz. FIG. 5 illustrates the phase performance in which phase shift in degrees is plotted against an ideal 180-degree phase shift over a frequency range of about 2 GHz to about 18 GHz. FIG. 6 illustrates the phase bit return loss measured in minus decibels plotted against frequency again over the range of 2 to 18 GHz.

We claim:

1. A wideband 180-degree phase shifter bit operable independently of input frequency over a predetermined bandwidth of interest to produce a 180-degree phase shifted rf output comprising;

(a) coupled transmission line segments with opposed ends of each line being connectable respectively to rf input and rf output, with the other end of each line being grounded;

(b) a pi network transmission line segment having a central line portion having opposed ends from which extend grounded line portions, and which opposed ends are respectively connectable to the rf input and rf output; and (c) switching means for alternatively connecting the rf input and rf output to the coupled transmission line segments and to the pi network.

2. The phase shifter bit set forth in claim 1, wherein the switching means connecting the rf input to the coupled transmission line segment and the pi network segment comprises a pair of field effect transistors, with the drive of each transistor connected via impedance matching means to the rf input terminal, the gates of each transistor are connected to bias networks, and the sources are connected respectively to the coupled transmission line segment and to the pi network segment, and the switching means connecting the rf output to the coupled transmission line segment and the pi network segment comprises a pair of field effect transistors, with the drive of each transistor connected via impedance matching means to the rf output terminal, the gates of each transistor are connected to bias networks, and the sources are connected respectively to the opposed end of the coupled transmission line segment and to the opposed end of the pi network.

3. The phase shifter bit set forth in claim 1, in combination with a serially connected analog phase shifter bit.

4. The phase shifter bit set forth in claim 1, wherein the coupled transmission line segments and the pi network transmission line segment are conductive strip lines disposed upon a thin insulating substrate, and the switching means comprise a pair of field effect transistors coupling the rf input and the rf output to opposed ends of the coupled transmission line segments and the pi network transmission line segments.

* * * * *